US009511925B2

(12) United States Patent
Edenilson

(10) Patent No.: US 9,511,925 B2
(45) Date of Patent: Dec. 6, 2016

(54) PUSH BUTTON FOR A SYSTEM FOR DISPENSING UNDER PRESSURE A PRODUCT

(71) Applicant: ALBEA DO BRASIL EMBALAGENS LTDA, Sao Paulo, Jundiai (BR)

(72) Inventor: Aldo Fadel Edenilson, Jundial (BR)

(73) Assignee: ALBEA DO BRASIL EMBALAGENS LTDA, Sao Paulo (BR)

( * ) Notice: Subject to any disclaimer, the term of this patent is extended or adjusted under 35 U.S.C. 154(b) by 0 days.

(21) Appl. No.: 14/849,664

(22) Filed: Sep. 10, 2015

(65) Prior Publication Data

US 2016/0068330 A1 Mar. 10, 2016

(30) Foreign Application Priority Data

Sep. 10, 2014 (EP) ..... 14184305

(51) Int. Cl.

| | |
|---|---|
| ***B65D 83/00*** | (2006.01) |
| ***B65D 83/20*** | (2006.01) |
| ***B05B 11/00*** | (2006.01) |
| ***B05B 1/22*** | (2006.01) |
| *B05B 11/02* | (2006.01) |

(52) U.S. Cl.

CPC ..... *B65D 83/20* (2013.01); *B05B 1/22* (2013.01); *B05B 11/0005* (2013.01); *B05B 11/3047* (2013.01); *B05B 11/3052* (2013.01); *B05B 11/02* (2013.01); *B65D 83/205* (2013.01)

(58) Field of Classification Search

CPC . B65D 83/20; B65D 83/205; B05B 11/0005; B05B 11/3047; B05B 11/3052; B05B 11/02; B05B 1/22

USPC ..... 222/402.1, 402.11–402.13, 222/321.6–321.9; 239/333, 322

See application file for complete search history.

(56) References Cited

U.S. PATENT DOCUMENTS 5,234,132 A * 8/1993 Bachand ..... B05B 11/3052 222/182

5,397,059 A * 3/1995 Baudin ..... B05B 7/066 222/321.2

(Continued)

FOREIGN PATENT DOCUMENTS

FR 2881721 8/2006

OTHER PUBLICATIONS

EP Application 14184305.2, European Search Report, dated Feb. 17, 2015.

*Primary Examiner* — Lien Ngo

(74) *Attorney, Agent, or Firm* — Banner & Witcoff, Ltd.

(57) ABSTRACT

A push button for a system for dispensing a product under pressure, the push button comprising an inner nozzle assembly which presents an upstream spout a lower end thereof intends to be mounted on a under pressure feed tube of the product. The inner nozzle assembly comprises a downstream spout which is in communication with the upstream spout and which ends in an outlet for dispensing under pressure the product. The push button comprises an outer body having a skirt which surrounds the inner nozzle assembly and an upper plate which comprises an upper zone for actuating the system for dispensing, the inner nozzle assembly being mounted within the outer body through a sliding guide until reaching a coupling position wherein the upstream spout is centered on first locking means provided below the upper plate and wherein the downstream spout is snapped on second locking means provided on the skirt.

14 Claims, 3 Drawing Sheets

(56) References Cited

U.S. PATENT DOCUMENTS

| | | | | |
|---|---|---|---|---|
| 8,444,023 | B2 * | 5/2013 | Rossignol | B05B 11/3053 222/321.7 |
| 9,205,973 | B2 * | 12/2015 | Decea | B65D 83/205 |
| 9,315,314 | B2 * | 4/2016 | Sell | B65D 83/22 |
| 2004/0112924 | A1 * | 6/2004 | Albisetti | B65D 83/206 222/402.13 |
| 2004/0140328 | A1 | 7/2004 | Pericard et al. | |
| 2008/0164285 | A1 * | 7/2008 | Hygema | B65D 83/205 222/153.11 |
| 2008/0164345 | A1 | 7/2008 | Belau et al. | |
| 2010/0206907 | A1 | 8/2010 | Angus et al. | |
| 2013/0037582 | A1 * | 2/2013 | Andersen | B65D 83/206 222/402.13 |
| 2014/0231463 | A1 * | 8/2014 | Goettke | B05B 11/3001 222/321.7 |

* cited by examiner

PUSH BUTTON FOR A SYSTEM FOR DISPENSING UNDER PRESSURE A PRODUCT

CROSS-REFERENCE TO RELATED APPLICATIONS

This application claims priority to European Patent Application Serial No. EP14184305.2, filed Sep. 10, 2014, which is hereby incorporated by reference in its entirety.

FIELD

The invention relates to a push button for a system for dispensing under pressure a product, a system for dispensing comprising a device for sampling provided with an under pressure feed tube whereon such a push button is mounted, and a bottle comprising a body in which a container intended for packaging a product is formed and that is equipped with such a system for dispensing to allow for the dispensing under pressure of said product.

BACKGROUND

Push buttons are known, comprising an outer body that comprises a skirt and an upper plate which comprises an upper zone for actuating the system for dispensing, especially upon pressure of a finger on said zone. To dispense under pressure a product, the push button further comprises an inner nozzle assembly surrounded by the skirt.

In particular, the nozzle assembly presents an upstream spout a lower end thereof intends to be mounted on an under pressure feed tube of the product, especially the feed tube of a device for sampling, for example a pump or a valve. The nozzle assembly further comprises a downstream spout which is in communication with the upstream spout and which ends in an outlet for dispensing under pressure the product.

Generally speaking, the nozzle assembly is made integral with the outer body, notably by moulding of a plastic material. However, this solution is problematic, notably in terms of aesthetic, as the nozzle assembly is formed into the outer body through a plastic mass which generates unsightly sinks marks on the surface of said outer body whereunder said nozzle assembly is linked.

Moreover, the more important the plastic mass is, the more visible the sink marks are, that is the sinks marks are more present on larger push buttons as those specifically designed for aesthetic and/or ergonomic purposes.

To solve this problem, it is known to provide a push button wherein the inner nozzle assembly and the outer body are made apart, and then assembled to each other by mounting said inner nozzle assembly within said outer body. Thus, the plastic mass to form the outer body is reduced, and then the sink marks on the surface of said body.

However, which such push buttons, it is necessary to mount the inner nozzle assembly with a perfect alignment with the outer body, and to secure said mounting, so as to prevent said nozzle assembly from unhooking of said outer body upon actuation of the system for dispensing, which could not only affect the quality of the dispensing of the product but also damage the device for sampling.

SUMMARY

The invention aims to improve the prior art by proposing a push button wherein an inner nozzle assembly is mounted within an outer body in such a way as to improve the aesthetical appearance of said push button while ensuring a perfect and reliable mounting of said inner nozzle assembly within said outer body.

For that purpose, according to a first aspect, the invention relates to a push button for a system for dispensing under pressure a product, said push button comprising an inner nozzle assembly which presents an upstream spout a lower end thereof intends to be mounted on a under pressure feed tube of the product, said inner nozzle assembly comprising a downstream spout which is in communication with said upstream spout and which ends in an outlet for dispensing under pressure the product, said push button comprising an outer body having a skirt which surrounds the inner nozzle assembly and an upper plate which comprises an upper zone for actuating the system for dispensing, the inner nozzle assembly being mounted within the outer body through a sliding guide until reaching a coupling position wherein the upstream spout is centred on first locking means provided below the upper plate and wherein the downstream spout is snapped on second locking means provided on the skirt.

According to a second aspect, the invention relates to a system for dispensing under pressure a product, comprising a device for sampling provided with a under pressure feed tube of the product whereon the lower end of the upstream spout of a such a push button is mounted in order to allow for the dispensing under pressure of the product.

According to a third aspect, the invention relates to a bottle for dispensing under pressure a product, said bottle comprising a body in which a container intended for packaging said product is formed, said body further being equipped with such a system for dispensing mounted to allow for the dispensing under pressure of said product.

BRIEF DESCRIPTION OF THE DRAWINGS

Other aspects and advantages of the invention will become apparent in the following description made with reference to the appended figures, wherein.

DETAILED DESCRIPTION

Figure 1:
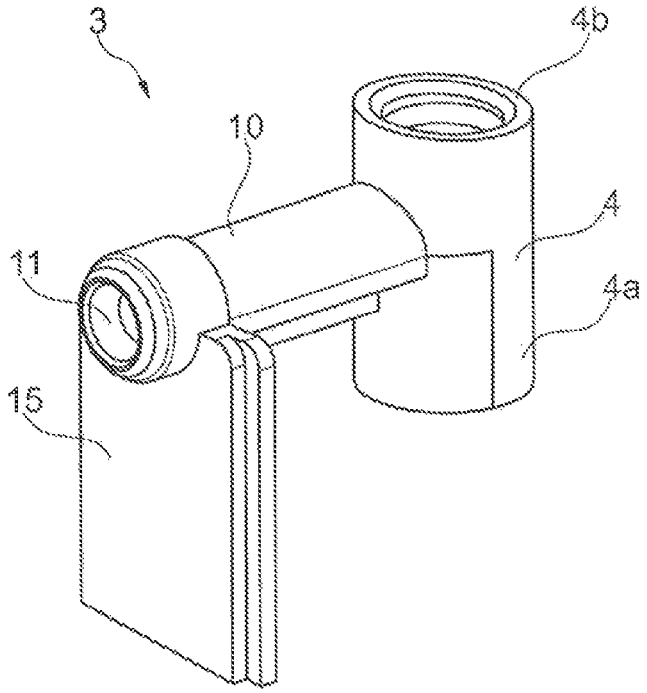
FIG. 1 represents in perspective an inner nozzle assembly for a push button according to an embodiment of the invention.

In relation to those figures, we describe below a push button for a system for dispensing under pressure a product, such as a system for dispensing comprising a device 1 for sampling provided with an under pressure feed tube 2 whereon such a push button is mounted. As an application example, the product to be dispensed under pressure is a perfume, a cosmetic product or a pharmaceutical product.

The push button comprises an inner nozzle assembly 3 which presents an upstream spout 4 a lower end 4*a* thereof intends to be mounted on the under pressure feed tube 2 of the product. Moreover, the push button comprises an outer body 5 having a skirt 6 which surrounds the inner nozzle assembly 3 and an upper plate 7 which comprises an upper zone 7*a* for actuating the system for dispensing, notably by allowing the user to press with his finger on said upper zone to displace said push button axially.

Figure 4A:
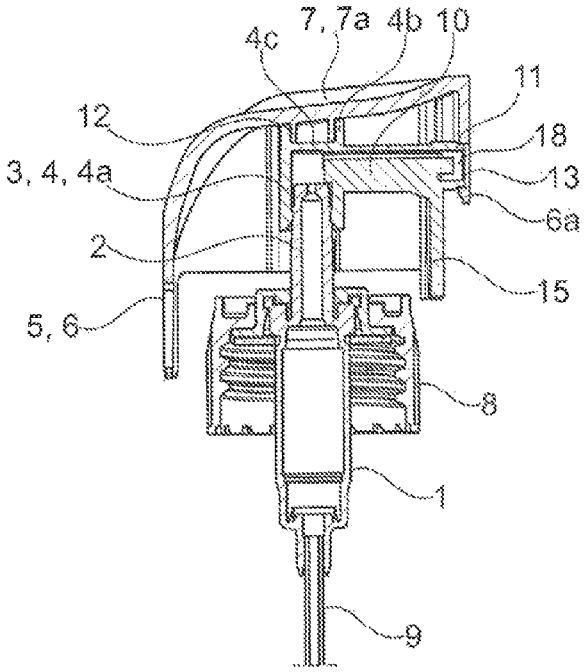
FIGS. 4*a* and 4*b* represent the push button of FIG. 3 mounted on a system for dispensing under pressure a product, respectively in longitudinal section (FIG. 4*a*) and in perspective view from below (FIG. 4*b*).
Figure 4B:
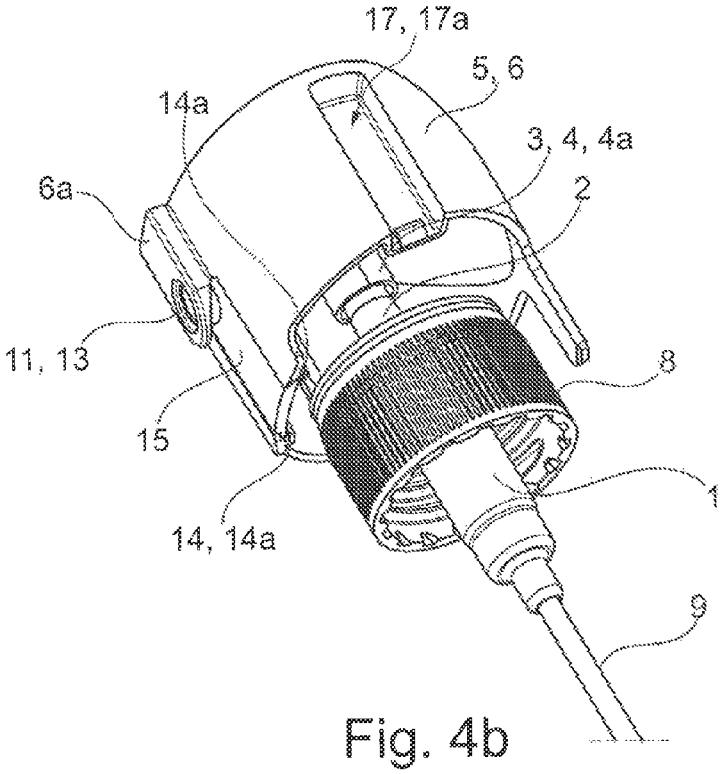

In relation with FIG. 4, the system for dispensing comprises a device 1 for sampling provided with a under pressure feed tube 2 of the product which is inserted in a sealed manner in the lower end 4*a* of the upstream spout 4 in order to allow, upon axial displacement of the push button, for the displacing of said feed tube on a dispensing/aspiring path, and thus for the dispensing under pressure of said product.

The device 1 for sampling can include a manually actuated pump or, in the case where the product is packaged under pressure in the body of the bottle, a manually actuated valve. As such, during a manual displacement of the push button, the pump or the valve is actuated to supply the feed tube 2 with the product under pressure.

In particular, a manually actuated pump classically comprises a body wherein means for putting under pressure the product to be dispensed are arranged. According to a particular embodiment, the pump is of the airless type, i.e. without air intake for compensating the amount of product that has been dispensed, so as to prevent infringement of contaminated product into the packaged product.

In a known manner, the system for dispensing is intended to equip a bottle for dispensing under pressure a product (not represented), said bottle comprising a body in which a container intended for packaging said product is formed and whereon said system is intended to be mounted to allow for the dispensing under pressure of said packaged product. To do so, the system for dispensing comprises means for mounting on the body of a bottle, as for example a screw plug 8 on which the device 1 for sampling is mounted and which is intended to be screwed on a neck of said body.

Moreover, the system for dispensing comprises means for sampling the product inside the container which are arranged to supply the feed tube 2 with the product under pressure, said means comprising for example a dip tube 9 mounted on a lower end of the device 1 for sampling (as represented on FIG. 4), or a piston which is slidably mounted within said container so as to push the product into said device for sampling.

The inner nozzle assembly 3 further comprises a downstream spout 10 which is in communication with the upstream spout 4 and which ends in an outlet 11 for dispensing under pressure the product. In relation to the figures, the upstream spout 4 extends longitudinally and the downstream spout 10 extends laterally. In the description, the orientation is taken as regards the direction of actuation of the push button.

This embodiment allows for a lateral dispensing under pressure of the product relatively to the outer body 5 of the push button. More precisely, the skirt 6 of the outer body 5 has an elliptic geometry and the lateral downstream spout 10 is designed to dispense the product through the elongated surface of said geometry opposite to the feed tube 2.

In particular, the inner nozzle assembly 3 can be made in one piece, the downstream spout 10 being connected in product communication to the upstream spout 4. Alternatively, the upstream 4 and downstream 10 spouts can be made apart, for example by moulding, and then connected together in product communication to form the inner nozzle assembly 3.

Thus, by mounting the lower end 4*a* of the upstream spout 4 on the feed tube 2, the dispensing under pressure of the product is achieved upon manual pressure on the outer body 5 to actuate the displacement of said feed tube, so as to route under pressure the packaged product from the feed tube 2 to the dispensing outlet 11 of the downstream spout 10. For dispensing a liquid product, an insert 18 can be fitted inside the outlet 11 to produce a spray.

For forming the push button, the inner nozzle assembly 3 and the outer body 5 are first made apart, for example through moulding. In particular, the outer body 5 is made with first locking means 12 provided below the upper plate 7 and with second locking means 13 provided on the skirt 6. Then, the inner nozzle assembly 3 is mounted within the outer body 5 in a coupling position wherein the upstream spout 4 is centred on the first locking means 12 and wherein the downstream spout 10 is snapped on the second locking means 13.

In particular, the first locking means 12 are arranged to centre the upstream spout 4 as regards the feed tube 2, so as to ensure a perfect alignment of said upstream spout with said feed tube during the axial displacement of the push button. Thus, the feed tube 2 is displaced collinearly with the push button and with the axe of the device 1 for sampling.

This embodiment not only ensures the reliability of the product communication between the feed tube 2 and the inner nozzle assembly 3, but also ensures the correct actuation of the device 1 for sampling while preventing the eventual damages of said device which could result from a misalignment of the feed tube 2 with said device.

In relation to the figures, the first locking means comprise a pin 12 arranged on a lower wall of the upper plate 7, the upstream spout 4 comprising an upper end 4*b* which is engaged on said pin in the coupling position. In particular, the pin 12 is made with a reduced height, so as to limit the plastic mass extending below the upper plate 7, and thus to reduce the sink marks on the upper zone 7*a* of said upper plate.

In the embodiment shown, the pin 12 and the upstream spout 4 both comprise a cylindrical body that are arranged so that the upper end 4*b* of said upstream spout is engaged on said pin by mounting said pin in serrated contact within said upper end. According to variants, the pin 12 and the upstream spout 4 can be arranged with other shapes and/or can be arranged for the mounting in serrated contact of the upper end 4*b* of said upstream spout within said pin.

In particular, the body of the pin 12 can comprise an annular protrusion formed on an exterior wall of said body, said annular protrusion being snapped within the upper end 4*b* of the upstream spout 4 so as to reinforce the mounting of said pin within said upper end. In particular, the annular protrusion can be arranged to generate a little click noise when snapped within the upper end 4*b*, so as to indicate that the upstream spout 4*b* is correctly centred on said pin.

Moreover, the upstream spout 4 comprises a transverse wall 4*c* which sealingly separates the upper end 4*b* from the remaining part of said upstream spout, so as to avoid any product leaking from said upper end upon actuation of the system for dispensing. In particular, the height of the upper end 4*b* which extends above the transverse wall 4*c* is arranged so that, when the pin 12 is mounted within said upper end, said pin abuts against said transverse wall while said upper end abuts against the lower wall of the upper plate 7.

Besides, the second locking means 13 are arranged to ensure the reliability of the mounting of the inner nozzle assembly 3 within the outer body 5, and thus the reliability of the alignment between the upstream spout 4 and the feed tube 2 during the axial displacement of the push button.

In particular, the second locking means 13 are arranged to prevent a disengagement of the upstream spout 4 from the first locking means 12, which may notably occur when the user presses his finger on an offset portion of the upper zone 7*a*, such a disengagement may triggering an undesired misalignment between the upstream spout 4 and the feed tube 2.

In relation to figures, the second locking means comprise a locking orifice 13 arranged in the skirt 6, the dispensing outlet 11 of the downstream spout 10 being snapped within said orifice in the coupling position. In particular, the skirt 6 comprises a front portion 6*a* which protrudes from said skirt and wherein the locking orifice 13 is arranged.

Moreover, the inner nozzle assembly 3 is mounted within the outer body 5 through a sliding guide 14 until reaching the coupling position wherein the upper end 4*b* of the upstream spout 4 is engaged on the pin 12 and the dispensing outlet 11 is snapped in the locking orifice 13, so as to permit for aligning at the same time respectively said upper end with said pin and said dispensing outlet with said locking orifice, and thus for ensuring a correct mounting of the push button.

Figure 2A:
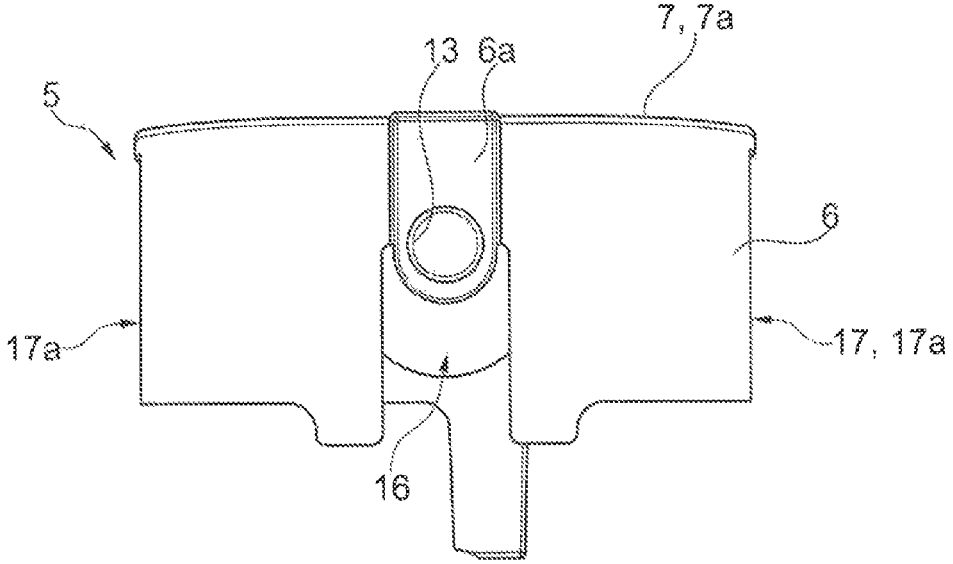
FIGS. 2*a* and 2*b* represent an outer body for a push button according to an embodiment of the invention, respectively in front view (FIG. 2*a*) and in below view (FIG. 2)
Figure 2B:
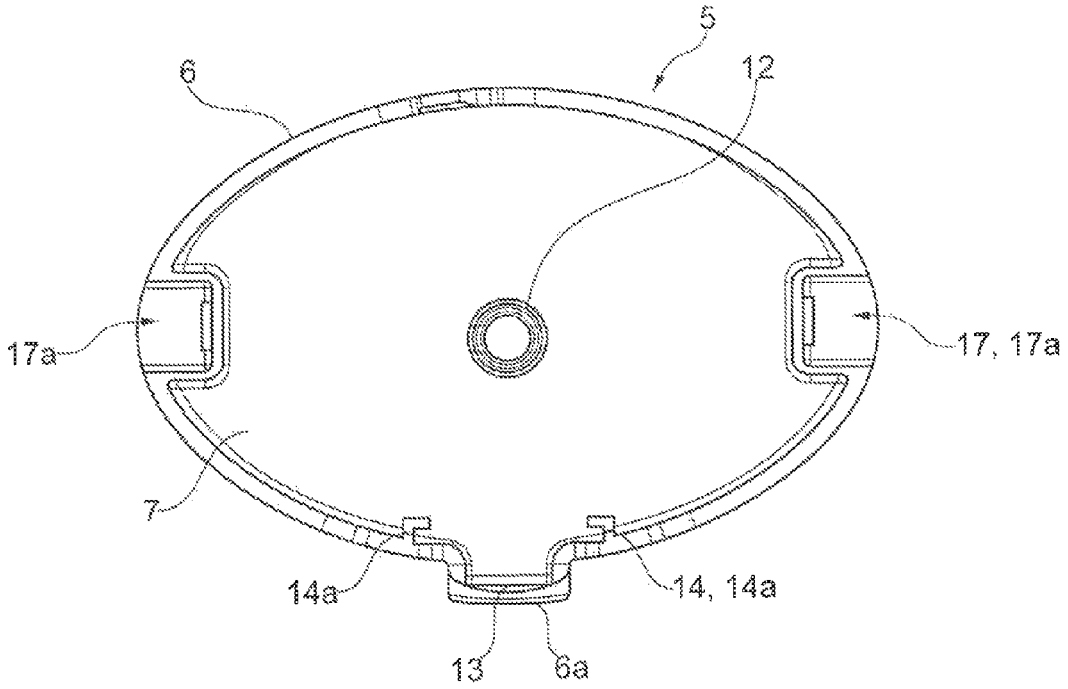
Figure 3:
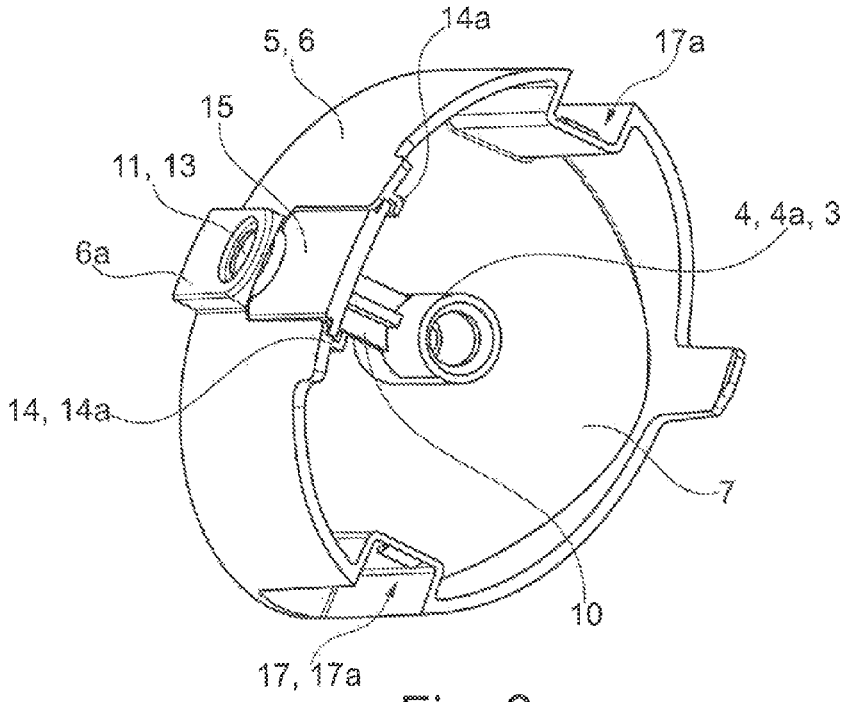
FIG. 3 represents in perspective view from below a push button comprising the inner nozzle assembly of FIG. 1 and the outer body of FIG. 2.

In relation with FIGS. 1 to 3, the sliding guide 14 comprises sliding tracks 14*a* arranged on the skirt 6, and the inner nozzle assembly 3 comprises a tray 15 which is slidably mounted in said tracks for the mounting of said inner nozzle assembly within the outer body 5.

In particular, the tray 15 extends below the dispensing outlet 11 on the downstream spout 10, and the sliding tracks 14*a* are arranged below the locking orifice 13 on the skirt 6, which constitutes an embodiment particularly convenient.

Moreover, the skirt 6 comprises an open slot 16 which extends on at least a part of the high of said skirt, especially below the front protruding portion 6*a* comprising the locking orifice 13, and on each side thereof the sliding tracks 14*a* are arranged, so that to easily locate the position of said sliding tracks.

For aesthetical reasons, the push button can further comprise a trim shroud which presents a housing wherein the outer body 5 is mounted in translation, said trim shroud comprising a skirt which surrounds the skirt 6 of said outer body and which comprises a longitudinal slot wherein the dispensing outlet 11 is arranged.

In particular, the longitudinal slot can be arranged to receive the front protruding portion 6*a* of the outer body 5 wherein the dispensing outlet 11 is arranged, notably by presenting similar dimensions to those of said protruding portion, so as to further improve the aesthetical appearance of the push button.

The trim shroud can be mounted on the body of the bottle after the mounting on said body of the system for dispensing equipped with the push button, for example through anchoring of a lower end of the skirt of said trim shroud on a shoulder for linking the neck to the body of said bottle.

Advantageously, the outer body 5 is guided in translation in the trim shroud through translation guiding means 17. In particular, the translation guiding means 17 can comprise at least one longitudinal protrusion arranged in one of the skirts of the outer body 5 and the trim shroud, said protrusion being arranged to slide in a longitudinal housing 17*a* arranged on the other of said skirts when the outer body 5 is moved in translation within the trim shroud.

In relation to figures, the skirt 6 of the outer body 5 comprises two longitudinal housings 17*a* that are diametrically opposite and wherein respectively a longitudinal protrusion arranged on the skirt of the trim shroud (not represented) is arranged to slide when the outer body 5 is moved in translation within said trim shroud.

I claim:

1. A Push button for a system for dispensing under pressure a product, said push button comprising an inner nozzle assembly which presents an upstream spout a lower end thereof intends to be mounted on a under pressure feed tube of the product, said inner nozzle assembly comprising a downstream spout which is in communication with said upstream spout and which ends in an outlet for dispensing under pressure the product, said push button comprising an outer body having a skirt which surrounds the inner nozzle assembly and an upper plate which comprises an upper zone for actuating the system for dispensing, said push button being characterized in that the inner nozzle assembly is mounted within the outer body through a sliding guide until reaching a coupling position wherein the upstream spout is centred on first locking means provided below the upper plate and wherein the downstream spout is snapped on second locking means provided on the skirt.

2. The Push button according to claim 1, characterized in that the first locking means comprise a pin arranged on a lower wall of the upper plate, the upstream spout comprising an upper end which is engaged on said pin in the coupling position.

3. The Push button according to claim 1, characterized in that the second locking means comprise a locking orifice arranged in the skirt, the dispensing outlet of the downstream spout being snapped within said orifice in the coupling position.

4. The Push button according to claim 1, characterized in that the sliding guide comprises sliding tracks arranged on the skirt, the inner nozzle assembly comprising a tray which is slidably mounted in said tracks for the mounting of said inner nozzle assembly within the outer body.

5. The Push button according to claim 3, characterized in that the tray extends below the dispensing outlet on the downstream spout, the sliding tracks being arranged below the orifice on the skirt.

6. The Push button according to claim 4, characterized in that the skirt comprises an open slot which extends on at least a part of the high of said skirt, the sliding tracks being arranged on each side of said slot.

7. The Push button according to claim 1, characterized in that it further comprises a trim shroud which presents a housing wherein the outer body is mounted in translation, said trim shroud comprising a skirt which surrounds the skirt, said skirt comprising a longitudinal slot wherein the dispensing outlet is arranged.

8. The Push button according to claim 7, characterized in that the outer body is guided in translation in the trim shroud through translation guiding means.

9. The Push button according to claim 8, characterized in that the translation guiding means comprise at least one longitudinal protrusion arranged in one of the skirts of the outer body and the trim shroud, said protrusion being arranged to slide in a longitudinal housing arranged on the other of said skirts when the outer body is moved in translation within the trim shroud.

10. The Push button according to claim 1, characterized in that the upstream spout extends longitudinally and the downstream spout extends laterally.

11. The Push button according to claim 1, characterized in that the inner nozzle assembly is made in one piece, the downstream spout being connected in product communication to the upstream spout.

12. A System for dispensing under pressure a product, comprising a device for sampling provided with a under pressure feed tube of the product whereon the lower end of the upstream spout of a push button according to claim 1 is mounted in order to allow for the dispensing under pressure of the product.

13. The System for dispensing according to claim 12, characterized in that the first looking means are arranged to centre the upstream spout as regards the feed tube.

14. A Bottle for dispensing under pressure a product, said bottle comprising a body in which a container intended for packaging said product is formed, said body further being equipped with a system for dispensing according to claim 12 mounted to allow for the dispensing under pressure of said product.

* * * * *